US007259543B2

(12) United States Patent
Chih

(10) Patent No.: US 7,259,543 B2
(45) Date of Patent: Aug. 21, 2007

(54) SUB-1V BANDGAP REFERENCE CIRCUIT

(75) Inventor: Yue-Der Chih, Hsin-Chu (TW)

(73) Assignee: Taiwan Semiconductor Manufacturing Co., Hsin-Chu (TW)

( * ) Notice: Subject to any disclaimer, the term of this patent is extended or adjusted under 35 U.S.C. 154(b) by 0 days.

(21) Appl. No.: 11/244,954

(22) Filed: Oct. 5, 2005

(65) Prior Publication Data

US 2007/0075699 A1 Apr. 5, 2007

(51) Int. Cl.
*G05F 3/20* (2006.01)
*G05F 3/26* (2006.01)

(52) U.S. Cl. ..... 323/316; 323/314

(58) Field of Classification Search ..... 323/313, 323/314, 315, 316, 907; 327/539
See application file for complete search history.

(56) References Cited

U.S. PATENT DOCUMENTS 5,034,626 A * 7/1991 Pirez et al. ..... 327/542
5,049,833 A * 9/1991 Miller ..... 330/253
6,242,897 B1 * 6/2001 Savage et al. ..... 323/313
6,784,652 B1 * 8/2004 Aude ..... 323/316
6,791,308 B2 * 9/2004 Shim ..... 323/314
6,906,581 B2 * 6/2005 Kang et al. ..... 327/539
7,122,998 B2 * 10/2006 Chen ..... 323/314

OTHER PUBLICATIONS

Banba, Hironori et al., "A CMOS Bandgap Reference Circuit with Sub-1-V Operation", IEEE Journal of Solid-State Circuits, (May 1999) vol. 34, No. 5, pp. 670-674.

* cited by examiner

*Primary Examiner*—Gary L Laxton
(74) *Attorney, Agent, or Firm*—Kirkpatrick & Lockhart Preston Gates Ellis LLP

(57) ABSTRACT

A bandgap reference circuit is disclosed operating under a predetermined low voltage source. The circuit has a first circuit with a first differential amplifier for generating a first current, a second circuit with a second differential amplifier for generating a second current, and a bandgap reference voltage output module for combining the first current and the second current to output a bandgap reference voltage, wherein the first circuit and the second circuit complement each other for offsetting variations of the bandgap reference voltage due to temperature changes.

16 Claims, 4 Drawing Sheets

SUB-1V BANDGAP REFERENCE CIRCUIT

BACKGROUND

The present invention relates generally to an integrated circuit (IC) design, and more particularly to a system of bandgap reference circuit that is capable of below 1 volt operations and designed for providing other ICs with a reference voltage.

Voltage reference is a necessary functional block for the operation of mixed-mode and analog integrated circuits (ICs) such as data converters, phase lock-loops (PLL), oscillators, power management circuitries, dynamic random access memory (DRAM), flash memory, and much more. A voltage reference must be, at least inherently, well-defined and insensitive to temperature, power supply and load variations. The resolutions of the ICs mentioned above, such as the data converters, are limited by the precision of its reference voltage over the circuit's supply voltage and operating temperature ranges. The bandgap reference voltage is required to exhibit both high power supply rejection and low temperature coefficient, and is probably the most popular high performance voltage reference used in ICs today. IC design is now predominated by low power, low voltage objectives, making complementary metal-oxide-semiconductor (CMOS) the technology of choice.

An early attempt for the solution is a conventional bandgap reference circuit that uses conventional bipolar technology to create a stable low reference voltage at around 1.2 volts. This conventional bandgap reference circuit is designed to provide a stable reference voltage at a targeted operation point, i.e. 1.2 volts. However, a zero-current state is also a stable operating point, and the reference voltage may stay at the zero-current state even after the current of the bandgap reference circuit is built up. Therefore, this convention bandgap reference circuit is typically equipped with an additional start-up circuit. The start-up circuit is designed to provide a start-up current to initiate the current of the bandgap reference circuit to be built up. Once the current of the bandgap reference circuit is built up, the start-up current is turned off and the bandgap reference circuit will provide a stable reference voltage at the targeted operation point.

However, recent IC design typically requires sub-1 volt operation regions, thereby rendering conventional systems as discussed above not so satisfactory. While there exists other conventional bandgap reference circuits that can operate below 1 volt, there are still start-up issues. While start-up issues can be overcome by equipping these conventional circuits with start-up circuits, the existence of the interface between these conventional circuits and the start-up circuits often makes these conventional circuits unreliable.

Therefore, it is desirable to design a new bandgap reference circuit without start-up problems that can also operate at below 1 volt.

SUMMARY

In view of the foregoing, this invention provides a bandgap reference circuit that is operable under a predetermined low voltage such as below 1 volt.

In one embodiment of the present invention, the circuit has a first circuit with a first differential amplifier for generating a first current, a second circuit with a second differential amplifier for generating a second current, and a bandgap reference voltage output module for combining the first current and the second current to output a bandgap reference voltage, wherein the first circuit and the second circuit complement each other for offsetting variations of the bandgap reference voltage due to temperature changes.

The construction and method of operation of the invention, however, together with additional objects and advantages thereof will be best understood from the following description of specific embodiments when read in connection with the accompanying drawings.

DESCRIPTION

The present disclosure provides a bandgap reference circuit that is capable of operating under a predetermined low voltage source such as one below 1 volt.

Figure 1A:
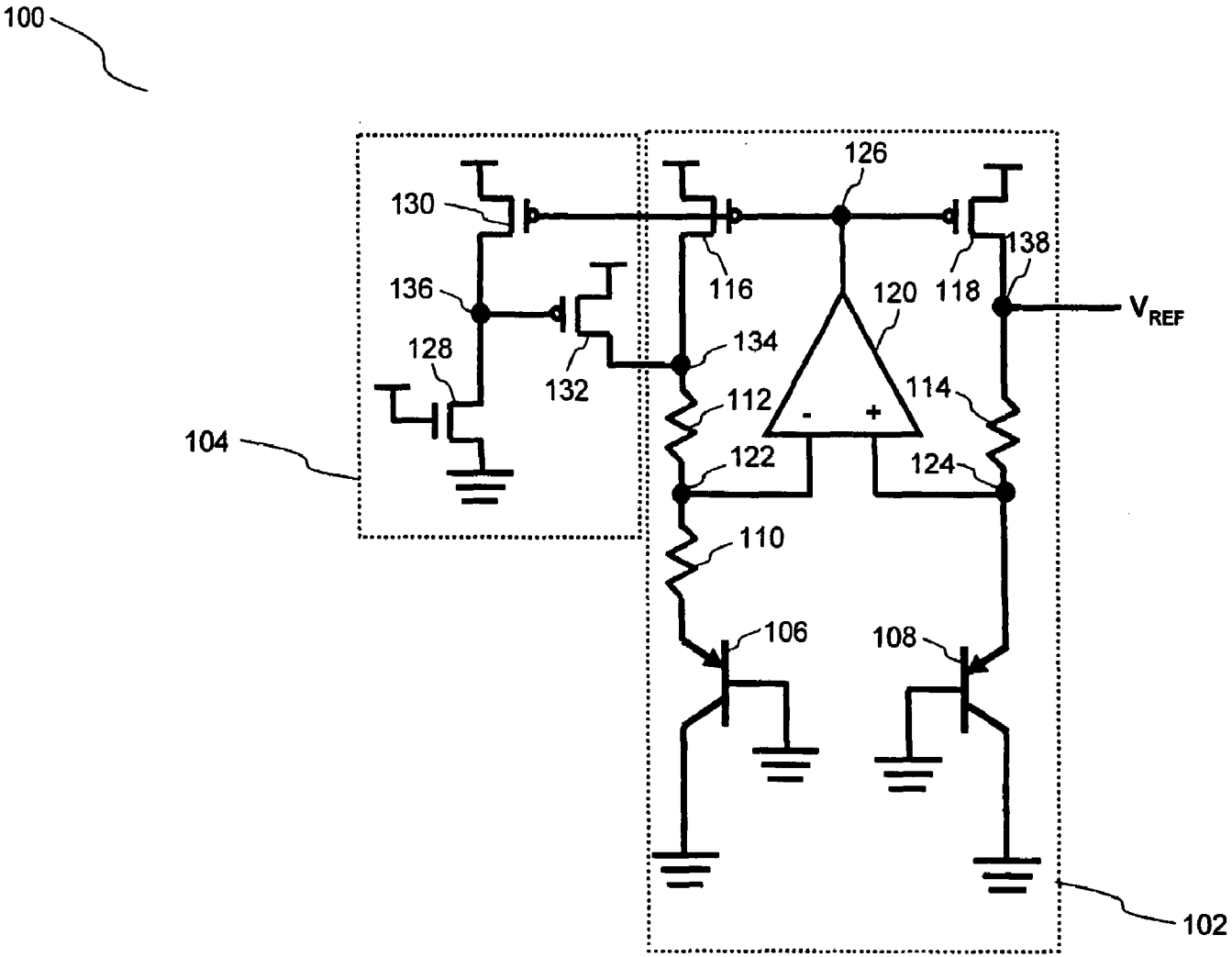
FIG. 1A (PRIOR ART)
FIG. 1A illustrates a circuit diagram showing a conventional bandgap reference circuit that is implemented with a start-up circuit.

FIG. 1A illustrates a circuit diagram 100 showing a conventional bandgap reference circuit 102 that is implemented with a start-up circuit 104. The conventional bandgap reference circuit 102 is designed to use conventional Bi-CMOS technology to create a stable low reference voltage at a targeted operation point, i.e. 1.2 volts. The start-up circuit 104 is designed to provide a start-up current for the conventional bandgap reference circuit 102 at the beginning of operation before the current of the conventional bandgap reference circuit 102 is built up. This is necessary since there are two stable operating points for the system: a targeted operating point and a zero-current state. Without the start-up circuit 104, it is possible for the reference voltage of the bandgap reference circuit 102 to stabilize at the zero-current state. With the start-up current, the bandgap reference circuit 102 can easily provide a stable reference voltage at the targeted operation point once the start-up current is turned off after the current of the bandgap reference circuit 102 is built up.

The conventional bandgap reference circuit 102 comprises two PNP bipolar transistors 106 and 108, three resistors 110, 112, and 114, two PMOS transistors 116 and 118, and a differential amplifier 120. Both the collectors and bases of the two PNP bipolar transistors 106 and 108 are tied to ground. The emitter of the PNP bipolar transistor 106 is coupled to a node 122 through the resistor 110, and the emitter of the PNP bipolar transistor 108 is coupled directly to a node 124. The sources of the PMOS transistors 116 and 118 are tied to the voltage source, while the drain of the PMOS transistor 116 is coupled to the node 122 through the resistor 112 and the drain of the PMOS transistor 118 is coupled to the node 124 through the resistor 114. Both gates of the PMOS transistors 116 and 118 are coupled together at a node 126. The node 122 is tied to the negative terminal of the differential amplifier 120 while the node 124 is tied to the positive terminal of the differential amplifier 120. The output of the differential amplifier 120 is coupled to the node 126. The start-up circuit 104, comprised of a NMOS transistor 128 and two PMOS transistors 130 and 132, is connected to the conventional bandgap reference circuit 102 at the node 126 through the gate of the PMOS transistor 130 and at a node 134 through the drain of the PMOS transistor 132. The sources of the PMOS transistors 130 and 132 and the gate of the NMOS transistor 128 are all tied to the voltage source, while the drain of the NMOS transistor 128, the gate of the PMOS transistor 132, and the drain of the PMOS transistor 130 are all coupled together at a node 136.

When the supply voltage is applied at the beginning of operation, the NMOS transistor 128 is turned on, thus pulling the node 136 low to ground. This turns on the PMOS transistor 132, thus pulling the node 134 high to the supply voltage. The node 122 is supplied with a voltage through the resistor 112, thus providing the negative terminal of the differential amplifier 120 with a signal. The emitter of the PNP bipolar transistor 106 will also be supplied with a voltage through the resistor 110.

With the help of the start-up circuit 104, the current of the conventional bandgap reference circuit 102 begins to build up. As such, the voltage at the node 122 that is connected to the negative terminal of the differential amplifier 120 is rising. The differential amplifier 120 is designed to sense the voltage difference between the node 122 and the node 124 before outputting a regulated voltage at the node 126 to control the PMOS transistors 130, 116, and 118. With the voltage at the node 124 that is also tied to the positive terminal of the differential amplifier 120 being equal to the emitter-to-base voltage $V_{EB}$ of the PNP bipolar transistor 108, the voltage at the node 122 will reach a level that is higher than the voltage at the node 124. This allows the differential amplifier 120 to output a regulated signal at the node 126 that will at least slightly turn on the PMOS transistors 130, 116, and 118, thus pulling up, respectively, the nodes 136, 134, and 138. This completes the start-up process of the conventional bandgap reference circuit 102 since the voltage at the node 136 will turn off the PMOS transistor 132. With the current in the bandgap reference circuit 102 built up, the start-up current has to be turned off. Otherwise, the non-zero start-up current from the start-up circuit 104 may impact the stability of the bandgap reference voltage at the node 138.

As the voltage levels change at both the node 122 and 124 during the operation of the bandgap reference circuit 102, the differential amplifier 120 will continue to sense the voltage difference between the two nodes 122 and 124 to provide a regulated signal at the node 126 to control the PMOS transistors 116 and 118, thereby further adjusting the level of current provided to the nodes 134 and 138. With this type of feedback system implemented, the bandgap reference voltage at the node 138 can be stabilized.

With this conventional system, the output reference voltage, Vref, at the node 138 is designed to be over 1.2 volts and is given by the following equation:

$$V\text{ref}=V_{EB108}+(R_{114}/R_{110})*V_T*ln(A_{106}/A_{108})$$

where the $A_{106}$ is the emitter area of the PNP bipolar transistor 106 and $A_{108}$ is the emitter area of the PNP bipolar transistor 108, while the $V_{EB108}$ is the emitter-to-base voltage of the PNP bipolar transistor 108.

However, recent IC design has reached below 1 volt making this conventional system unsatisfactory to many applications.

Figure 1B:
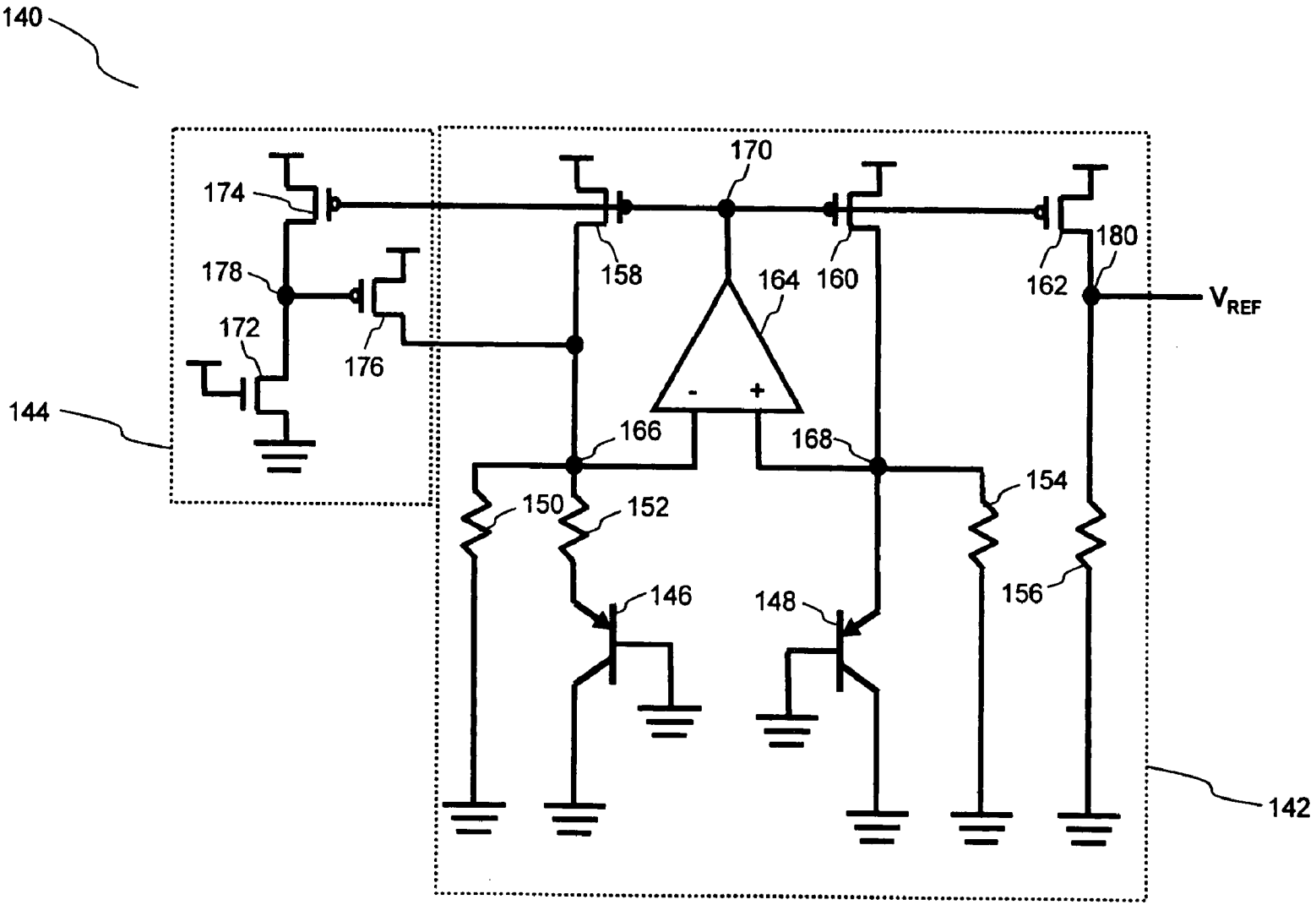
FIG. 1B (PRIOR ART)
FIG. 1B illustrates a circuit diagram showing another conventional bandgap reference circuit that is implemented with a start-up circuit.

FIG. 1B illustrates a circuit diagram 140 showing another conventional bandgap reference circuit 142 implemented with a start-up circuit 144.

The conventional bandgap reference circuit 142, similar to the conventional bandgap reference circuit 102 within FIG. 1A, is designed to use conventional Bi-CMOS technology to create a stable low reference voltage at a lower targeted operation point that is below 1 volt. The start-up circuit 144, which is the same as the start-up circuit 104 of FIG. 1A, is designed to provide a start-up current for the conventional bandgap reference circuit 142 at the beginning of operation before the current of the conventional bandgap reference circuit 142 is built up. This is necessary since there are two stable operating points for the system: a targeted operating point and a zero-current state. Without the start-up circuit 144, it is possible for the reference voltage of the bandgap reference circuit 142 to stabilize at the zero-current state. With the start-up current, the bandgap reference circuit 142 can easily provide a stable reference voltage at the targeted operation point once the start-up current is turned off after the current of the bandgap reference circuit 142 is built up.

The conventional bandgap reference circuit 142 comprises two PNP bipolar transistors 146 and 148, four resistors 150, 152, 154 and 156, three PMOS transistors 158, 160, and 162, and a differential amplifier 164. Both the collectors and base of the two PNP bipolar transistors 146 and 148 are tied to ground. The emitter of the PNP bipolar transistor 146 is coupled to a node 166 through the resistor 152, and the emitter of the PNP bipolar transistor 148 is coupled directly to a node 168. The resistor 150 is implemented between the ground and the node 166. The sources of the PMOS transistors 158, 160, and 162 are tied to the voltage source, while the drains of the PMOS transistors 158 and 160 are coupled respectively with the nodes 166 and 168. The drain of the PMOS transistor 162 is tied to ground through the resistor 156. The gates of the PMOS transistors 158, 160, and 162 are coupled together at a node 170. The node 166 is tied to the negative terminal of the differential amplifier 164 while the node 168 is tied to the positive terminal of the differential amplifier 164. The output of the differential amplifier 164 is coupled to the node 170. The start-up circuit 144, comprised of a NMOS transistor 172 and two PMOS transistors 174 and 176, is connected to the conventional bandgap reference circuit 142 at the node 170 through the gate of the PMOS transistor 174 and at the node 166 through the drain of the PMOS transistor 176. The sources of the PMOS transistors 174 and 176 and the gate of the NMOS transistor 172 are all tied to the voltage source, while the drain of the NMOS transistor 172, the gate of the PMOS transistor 176, and the drain of the PMOS transistor 174 are all coupled together at a node 178.

The operation of the conventional bandgap reference circuit 142 is similar to the conventional bandgap reference circuit 102 of FIG. 1A with the exception that this circuit is designed to provide a sub-1V bandgap reference voltage at a node 180.

With the help of the start-up circuit 144, the current of the conventional bandgap reference circuit 142 begins to build up. As such, the voltage at the node 166 that is connected to the negative terminal of the differential amplifier 164 is rising. The differential amplifier 164 is designed to sense the voltage difference between the node 166 and the node 168 before outputting a regulated voltage at the node 170 to control the PMOS transistors 158, 160, 162 and 174. With the voltage at the node 168 that is also tied to the positive terminal of the differential amplifier 164 being equal to the emitter-to-base voltage $V_{EB}$ of the PNP bipolar transistor 148, the voltage at the node 166 will reach a level that is higher than the voltage at the node 168. This allows the differential amplifier 164 to output a regulated signal at the node 170 that will at least slightly turn on the PMOS transistors 158, 160, 162, and 174, thus pulling up, respectively, the nodes 166, 168, 180, and 178. The node 180 is used for providing the reference voltage output. This completes the start-up process of the conventional bandgap reference circuit 142 since the voltage at the node 178 will turn off the PMOS transistor 176. With the current in the bandgap reference circuit 142 built up, the start-up current has to be turned off. Otherwise, the non-zero start-up current from the start-up circuit 144 may impact the stability of the bandgap reference voltage at the node 180.

As the voltage levels change at both the node 166 and 168 during the operation of the bandgap reference circuit 142, the differential amplifier 164 will continue to sense the voltage difference between the two nodes 166 and 168 to provide a regulated signal at the node 170 to control the PMOS transistors 158, 160, and 162, thereby further adjusting the level of current provided to the nodes 166, 168, and 180. With this type of feedback system implemented, the bandgap reference voltage at the node 180 can be stabilized.

While this design can provide a sub-1V bandgap reference signal, however, the start-up current of this design has experienced a problem in that it may not be able to turn off once the operating point is back to normal. The start-up of this bandgap reference circuit is only conditionally successfully even with the start-up circuit 144 implemented.

Figure 2:
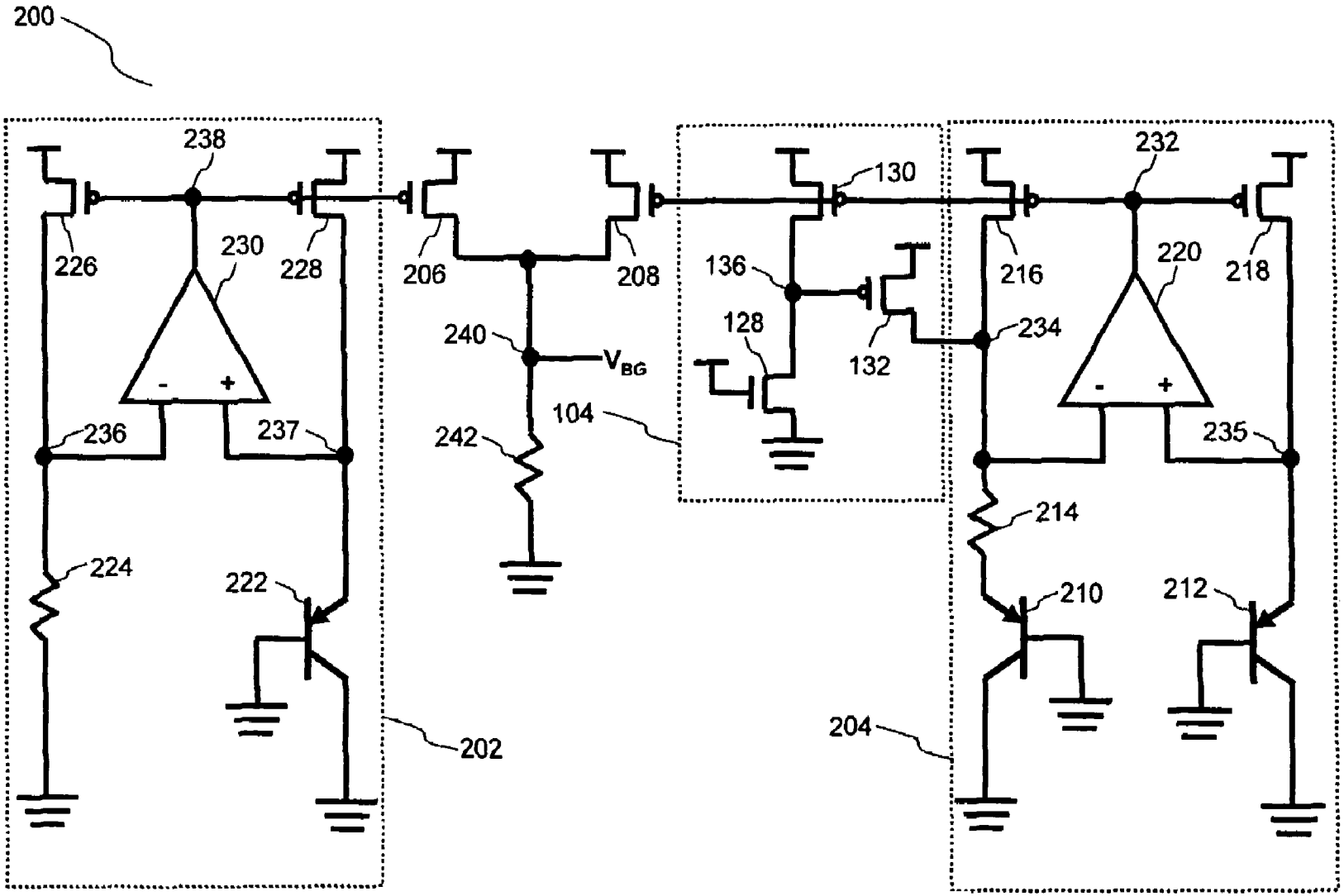
FIG. 2 illustrates a bandgap reference circuit in accordance with a first embodiment of the present invention.

FIG. 2 illustrates a bandgap reference circuit 200 in accordance with a first embodiment of the present invention. The bandgap reference circuit 200 includes a complementary-to-absolute-temperature (CTAT) circuit 202, the start-up circuit 104, and a proportional-to-absolute-temperature (PTAT) circuit 204. The PTAT circuit 204 is identical to the conventional bandgap reference circuit 102 of FIG. 1 with the exception of the missing resistors 112 and 114. The bandgap reference circuit 200 is a precision voltage reference circuit, in which the negative temperature dependency of a voltage source is cancelled by the positive voltage dependency of another voltage source, thus resulting in a stable voltage at the reference temperature which is equal to the bandgap voltage of the semiconductor at the reference temperature. In order to achieve this, the CTAT circuit 202 is designed to generate a CTAT current with a CTAT voltage, while the PTAT circuit 204 is designed to generate a PTAT current with a PTAT voltage. The CTAT voltage represents the complementary-to-absolute-temperature voltage, meaning that the variation in voltage is complementary to temperature whereby the voltage decreases with increase of temperature. The PTAT voltage represents the proportional-to-absolute-temperature voltage, meaning that the variation in voltage is proportional to temperature whereby the voltage increases with the increase of the temperature. The CTAT and PTAT currents are summed by a set of PMOS transistors 206 and 208 before generating a reference bandgap voltage Vbg. This reference bandgap voltage Vbg is designed to be insensitive to any changes in the temperature or power supply.

The PTAT circuit 204 comprises two PNP bipolar transistors 210 and 212, a resistor 214, two PMOS transistors 216 and 218, and a differential amplifier 220. The CTAT circuit 202 comprises a PNP bipolar transistor 222, a resistor 224, two PMOS transistors 226 and 228, and a differential amplifier 230. The PTAT circuit 204 is designed to operate in a manner similar to the conventional bandgap reference circuit 102, in which two stable operating points are provided to allow a simple start-up circuit such as the start-up circuit 104 to be used to reliably start up the PTAT circuit 204 and to activate the bandgap reference circuit 200.

The start-up circuit 104, comprised of the NMOS transistor 128 and the two PMOS transistors 130 and 132, is connected to the PTAT circuit 204 at a node 232 through the gate of the PMOS transistor 130 and at a node 234 through the drain of the PMOS transistor 132. The sources of the PMOS transistors 130 and 132 and the gate of the NMOS transistor 128 are all tied to the voltage source, while the drain of the NMOS transistor 128, the gate of the PMOS transistor 132, and the drain of the PMOS transistor 130 are all coupled together at the node 136.

When the supply voltage is applied at the beginning of operation, the NMOS transistor 128 is turned on, thus pulling the node 136 low to ground. This turns on the PMOS transistor 132, thus pulling the node 234 high to the supply voltage. With the help of the start-up circuit 104, the current of the PTAT circuit 204 begins to build up. Accordingly, the voltage at the node 234 that is connected to the negative terminal of the differential amplifier 220 is rising. The differential amplifier 220 is designed to sense the voltage difference between the node 234 and a node 235 before providing a regulated voltage at the node 232 to control the PMOS transistors 130, 216, 218, and 208. With the voltage at the node 235 that is also tied to the positive terminal of the differential amplifier 220 being equal to the emitter-to-base voltage $V_{EB}$ of the PNP bipolar transistor 212, the voltage at the node 234 will reach a level that is higher than the voltage at the node 235. This allows the differential amplifier 220 to output a regulated signal at the node 232 that will at least slightly turn on the PMOS transistors 130, 216, and 218, thus pulling up the nodes 136, 234, and 235. This completes the start-up process of the PTAT circuit 204 since the voltage at the node 136 will turn off the PMOS transistor 132. Meanwhile, the CTAT circuit 202 may be able to operate without a start-up circuit since the negative terminal of the differential amplifier is tied to ground through the resistor 224.

The CTAT circuit 202 operates in a manner similar to the PTAT circuit 204, since the differential amplifier 230 is also designed to sense the voltage difference between a node 236 and a node 237 before providing a regulated voltage at a node 238 to control the PMOS transistors 206, 226, and 228. For example, when the voltage at the node 236 is higher than the voltage at the node 237, a regulated voltage will be provided at the node 238 that will at least slightly turn on the PMOS transistors 226, 228, and 206.

In the PTAT circuit 204, as the voltage levels change at both the nodes 234 and 235 during the operation of the bandgap reference circuit 200, the differential amplifier 220 will continue to sense the voltage difference between the two nodes 234 and 235 to provide a regulated signal at the node 232 to control the PMOS transistors 216 and 218, thereby adjusting the level of current provided to the nodes 234 and 235.

With this type of feedback systems implemented for both the PTAT circuit 204 and the CTAT circuit 202, the current flowing through both the PMOS transistors 206 and 208 can be stabilized. The CTAT current flowing through the PMOS transistor 206 and PTAT current flowing through the PMOS transistor 208 are summed together at a node 240. The combination of the PMOS transistors 206 and 208, and the resistor 242 constitutes a bandgap voltage output module that provides a bandgap reference voltage Vbg. The value of this bandgap reference voltage can be obtained by multiplying the summed current at the node 240 and the resistance value of the resistor 242.

As it can be seen that the bandgap reference output module is in a current mirror configuration with the CTAT circuit on one hand and with the PTAT circuit on the other hand so that the currents can be combined for generating the bandgap reference voltage at node 240.

In an alternative embodiment, area can be saved by removing the PMOS transistor 218 and the PNP bipolar transistor 212 by coupling the positive terminal of the differential amplifier 220 to the node 237. This is possible since the configuration coupling the PMOS transistor 228 and the PNP transistor 222 is identical to the configuration coupling the PMOS transistor 218 and the PNP transistor 212 so that the PMOS transistor 228 and the PNP transistor 222 can be shared.

This invention provides a precision voltage, bandgap reference circuit, in which the negative temperature dependency of a voltage source is cancelled by the positive voltage dependency of another voltage source, thereby resulting in a stable voltage at the reference temperature which is equal to the bandgap voltage of the semiconductor at the reference temperature. These positive and negative voltages are represented by a CTAT voltage and a PTAT voltage, the former decreasing with an increase in temperature and the latter increasing with the increase in temperature.

Figure 3:
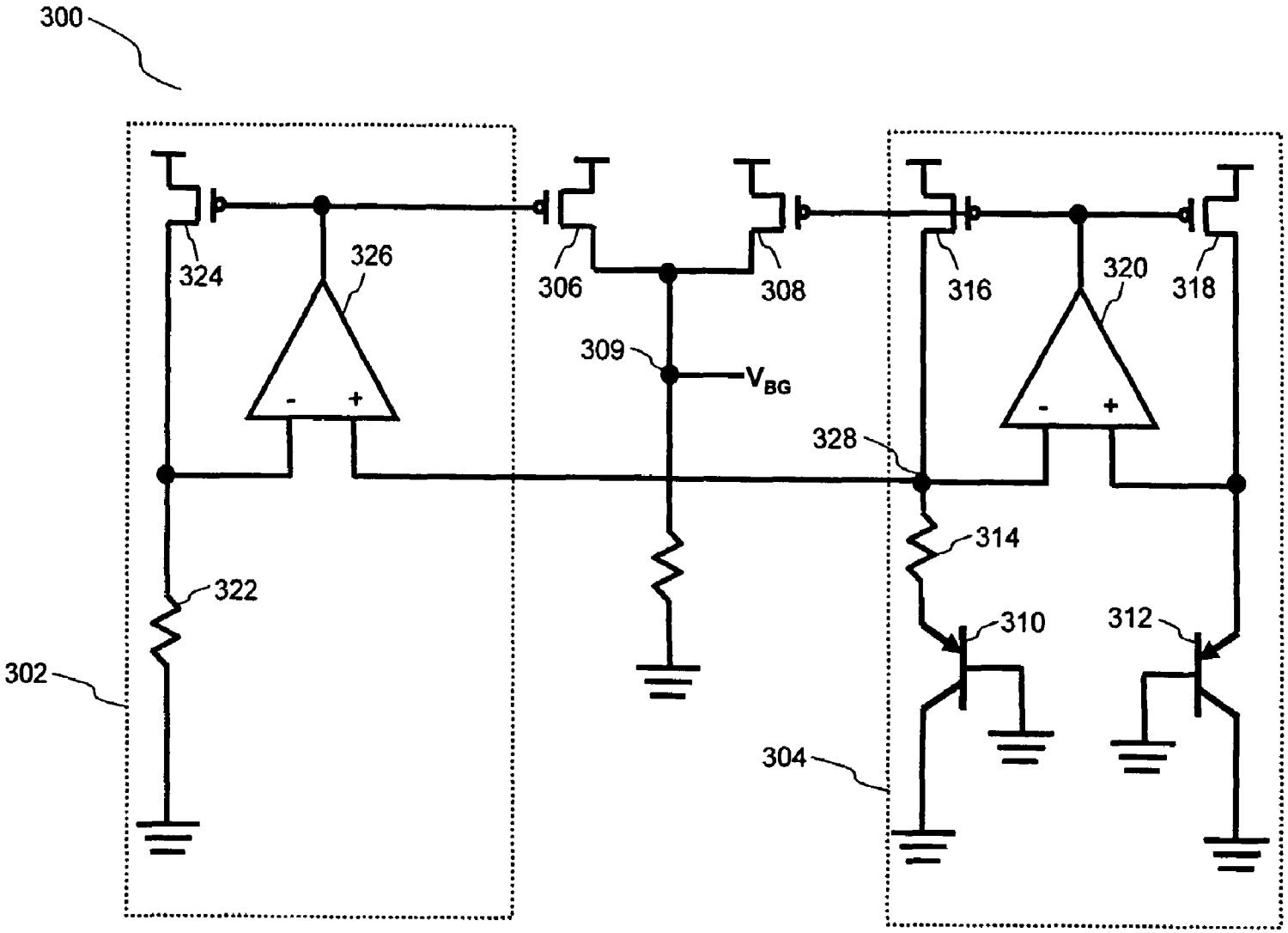
FIG. 3 illustrates a bandgap reference circuit in accordance with a second embodiment of the present invention.

FIG. 3 illustrates a bandgap reference circuit 300 in accordance with a second embodiment of the present invention. The bandgap reference circuit 300 includes a complementary-to-absolute-temperature (CTAT) circuit 302 and a proportional-to-absolute-temperature (PTAT) circuit 304. The PTAT circuit 304 is identical to the conventional bandgap reference circuit 102 of FIG. 1 with the exception of the missing resistors 112 and 114. The bandgap reference circuit 300 is a precision voltage reference circuit, in which the negative temperature dependency of a voltage source is cancelled by the positive voltage dependency of another voltage source, thus resulting in a stable voltage at the reference temperature which is equal to the bandgap voltage of the semiconductor at the reference temperature. In order to achieve this, the CTAT circuit 302 is designed to generate a CTAT current with a CTAT voltage, while the PTAT circuit 304 is designed to generate a PTAT current with a PTAT voltage. The CTAT voltage represents the complementary-to-absolute-temperature voltage, meaning that the variation in voltage is complementary to temperature whereby the voltage decreases with an increase in temperature. The PTAT voltage represents the proportional-to-absolute-temperature voltage, meaning that the variation in voltage is proportional to temperature whereby the voltage increases with the increase of the temperature. The CTAT and PTAT currents are summed by a set of PMOS transistors 306 and 308 before generating a reference bandgap voltage Vbg at a node 309. This reference bandgap voltage Vbg is designed to be insensitive to any changes in the temperature or power supply.

The PTAT circuit 304 comprises two PNP bipolar transistors 310 and 312, a resistor 314, two PMOS transistors 316 and 318, and a differential amplifier 320. The CTAT circuit 302 is only comprised of a resistor 322, a PMOS transistor 324, and a differential amplifier 326. The PTAT circuit 304 is designed to operate in a manner similar to the conventional bandgap reference circuit 102, in which two stable operating points are provided to allow a simple start-up circuit such as the start-up circuit 104 to be used to reliably start up the PTAT circuit 304 and to activate the bandgap reference circuit 300. Note that the optional start-up circuit is not shown within this figure.

The bandgap reference circuit 300 is designed to operate much like the bandgap reference circuit 200 of FIG. 2. The positive terminal of the differential amplifier 326 is coupled directly to the negative terminal of the differential amplifier 320 through a node 328. By having the CTAT circuit 302 share the PNP bipolar transistor 310, components and area can be saved while allowing the CTAT circuit 302 to operate in the same manner as the CTAT circuit 202 of FIG. 2.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A bandgap reference circuit operating under a voltage source comprising:

a first circuit with a first differential amplifier for generating a first current;

a second circuit with a second differential amplifier for generating a second current, wherein the first circuit and the second circuit comprise BiCMOS transistors;

a start-up circuit for providing an initial current to the first circuit, wherein the start-up circuit further comprises a NMOS transistor and a first PMOS transistor coupled in series with a gate of a second PMOS transistor coupled to drains of the first PMOS transistor and the NMOS transistor; and a bandgap reference voltage output module for combining the first current and the second current to output a bandgap reference voltage, wherein the first current increases while the second current decreases with the increase of temperature, thereby the first circuit and the second circuit complement each other for offsetting variations of the bandgap reference voltage due to temperature changes.

2. The circuit of claim 1, wherein the first circuit is a proportional-to-absolute-temperature circuit.

3. The circuit of claim 2, wherein the proportional-to-absolute-temperature circuit comprises:

a first and a second PNP bipolar transistors, whose bases and collectors are coupled with an electrical ground;

a first resistor coupled to the emitter of the first PNP bipolar transistor at its first end;

two PMOS transistors, whose drains are respectively coupled with the negative and the positive input terminals of the first differential amplifier, whose sources are coupled with the voltage source, and whose gates are coupled together at an output terminal of the first differential amplifier, wherein the positive input terminal of the first differential amplifier is coupled with the emitter of the second PNP bipolar transistor and the negative input terminal is coupled with the first resistor at its second end.

4. The circuit of claim 3, wherein the second circuit is a complementary-to-absolute-temperature circuit which further comprises:

a second resistor with its first end coupled to ground and its second end coupled to a negative input terminal of the second differential amplifier;

a PMOS transistor, whose drain is coupled to the negative input terminal of the second differential amplifier and whose source is coupled with the voltage source, and whose gate is coupled with an output terminal of the second differential amplifier, wherein the positive input terminal and the output terminal of the second differential amplifier are respectively coupled with the positive input terminal of the first differential amplifier and the gate of the PMOS transistor coupled to the positive input terminal of the first differential amplifier.

5. The circuit of claim 3 wherein the second circuit is a complementary-to-absolute-temperature circuit which further comprises:

a second resistor with its first end coupled to ground and its second end coupled to a negative input terminal of the second differential amplifier;

a PMOS transistor, whose drain is coupled to the negative input terminal of the second differential amplifier and whose source is coupled with the voltage source, and whose gate is coupled with an output terminal of the second differential amplifier, wherein the positive input terminal and the output terminal of the second differential amplifier are respectively coupled with the negative input terminal of the first differential amplifier and a gate of a PMOS transistor of the bandgap reference output module that mirrors the first current.

6. The circuit of claim 1, wherein the second circuit is a complementary-to-absolute-temperature circuit.

7. The circuit of claim 6, wherein the complementary-to-absolute-temperature circuit comprises:

a PNP bipolar transistor, whose base and collector are coupled with an electrical ground;

a resistor with its first end coupled to ground;

two PMOS transistors, whose drains are respectively coupled with the negative and the positive input terminals of the second differential amplifier, whose sources are coupled with the voltage source, and whose gates are coupled together at an output terminal of the second differential amplifier, wherein the positive input terminal of the second differential amplifier is coupled with the emitter of the PNP bipolar transistor and the negative input terminal is coupled with the resistor at its second end.

8. The circuit of claim 1, wherein the voltage source is under 1 volt.

9. A bandgap reference circuit comprising:

a first circuit with a first differential amplifier for generating a first current;

a second circuit with a second differential amplifier for generating a second current, wherein the first circuit is a proportional-to-absolute-temperature circuit, which further comprises:

a first and a second PNP bipolar transistors, whose bases and collectors are coupled with an electrical ground;

a first resistor coupled to the emitter of the first PNP bipolar transistor at its first end;

two PMOS transistors, whose drains are respectively coupled with the negative and the positive input terminals of the first differential amplifier, whose sources are coupled with the voltage source, and whose gates are coupled together at an output terminal of the first differential amplifier, wherein the positive input terminal of the first differential amplifier is coupled with the emitter of the second PNP bipolar transistor and the negative input terminal is coupled with the first resistor at its second end; and a bandgap reference voltage output module for combining the first current and the second current to output a bandgap reference voltage, wherein the first current increases while the second current decreases with the increase of temperature, thereby the first circuit and the second circuit complement each other for offsetting variations of the bandgap reference voltage due to temperature changes, and wherein the bandgap reference voltage output module is in a current mirror configuration with the first and second circuits respectively for combining the first current and the second current.

10. The circuit of claim 9, wherein the second circuit is a complementary-to-absolute-temperature circuit which further comprises:

a PMOS transistor; and a second resistor with its first end coupled to ground and its second end coupled to a negative input terminal of the second differential amplifier, wherein the drain of the PMOS transistor is coupled to the negative input terminal of the second differential amplifier, the source is coupled with the voltage source, and the gate is coupled with an output terminal of the second differential amplifier, and wherein the positive input terminal and the output terminal of the second differential amplifier are respectively coupled with the positive input terminal of the first differential amplifier and the gate of the PMOS transistor coupled to the positive input terminal of the first differential amplifier.

11. The circuit of claim 9 wherein the second circuit is a complementary-to-absolute-temperature circuit which further comprises:

a PMOS transistor; and a second resistor with its first end coupled to ground and its second end coupled to a negative input terminal of the second differential amplifier, wherein a drain of the PMOS transistor is coupled to the negative input terminal of the second differential amplifier, a source is coupled with the voltage source, and a gate is coupled with an output terminal of the second differential amplifier, and wherein the positive input terminal and the output terminal of the second differential amplifier are respectively coupled with the negative input terminal of the first differential amplifier and a gate of a PMOS transistor of the bandgap reference output module that mirrors the first current.

12. The circuit of claim 9, wherein the second circuit is a complementary-to-absolute-temperature circuit which further comprises:

a PNP bipolar transistor, whose base and collector are coupled with an electrical ground;

a resistor with its first end coupled to ground;

two PMOS transistors, whose drains are respectively coupled with the negative and the positive input terminals of the second differential amplifier, whose sources are coupled with the voltage source, and whose gates are coupled together at an output terminal of the second differential amplifier, and wherein the positive input terminal of the second differential amplifier is coupled with the emitter of the PNP bipolar transistor and the negative input terminal is coupled with the resistor at its second end.

13. The circuit of claim 9 further comprising a start-up circuit for providing an initial current to the first circuit.

14. The circuit of claim 13 wherein the start-up circuit further comprises a NMOS transistor and a first PMOS transistor coupled in series with a gate of a second PMOS transistor coupled to drains of the first PMOS transistor and the NMOS transistor.

15. A bandgap reference circuit operating under a voltage source no more than 1 volt comprising:

a proportional-to-absolute-temperature (PTAT) circuit having a first differential amplifier for generating a first current;

a complementary-to-absolute-temperature (CTAT) circuit having a second differential amplifier for generating a second current; and a bandgap reference voltage output module comprising two pull-up PMOS transistors each connected serially with a summation resistor at its drain for combining the first current and the second current, wherein the complementary-to-absolute-temperature circuit further comprises:

a first resistor coupled between an electrical ground and a negative input terminal of the second differential amplifier, wherein a positive input terminal of the second differential amplifier is coupled to a negative input terminal of the first differential amplifier wherein a bandgap reference voltage is provided at the drains of the two pull-up PMOS transistors of the bandgap reference voltage output module, and wherein the first current increases while the second current decreases with the increase of temperature, thereby the PTAT and CTAT circuits offset each other so that the bandgap reference voltage is temperature insensitive.

16. The circuit of claim 15, the proportional-to-absolute-temperature circuit further comprises:

a first and a second PNP bipolar transistors with both bases and collectors coupled with an electrical ground, and an emitter of the first PNP bipolar transistor coupled to a negative input terminal of the first differential amplifier through a first resistor and an emitter of the second PNP bipolar transistor coupled to a positive input terminal of the first differential amplifier; and two PMOS transistors, whose drains are respectively coupled with negative and positive input terminals of the first differential amplifier, whose sources are coupled with the voltage source, and whose gates are coupled together with an output terminal of the first differential amplifier.

* * * * *